US011578873B2

(12) United States Patent
Johnson

(10) Patent No.: US 11,578,873 B2
(45) Date of Patent: Feb. 14, 2023

(54) OVEN APPLIANCE AND METHOD FOR PREHEATING HIGH-HEAT COOKING SURFACE

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 48 days.

(21) Appl. No.: 17/215,126

(22) Filed: Mar. 29, 2021

(65) Prior Publication Data

US 2022/0307696 A1 Sep. 29, 2022

(51) Int. Cl.

| | |
|---|---|
| ***A47J 27/62*** | (2006.01) |
| ***F24C 7/08*** | (2006.01) |
| ***F24C 7/04*** | (2021.01) |
| *F24C 7/06* | (2006.01) |

(52) U.S. Cl.

CPC ..... *F24C 7/088* (2013.01); *F24C 7/043* (2013.01); *F24C 7/081* (2013.01); *F24C 7/062* (2013.01)

(58) Field of Classification Search

CPC ..... H05B 6/80; H05B 6/6423; A47J 27/62; A47J 37/0676; F24C 7/088; F24C 7/043; F24C 7/081; F24C 7/062

USPC ..... 99/325, 331, 339, 345, 348, 357, 422, 99/444, 447, 474, 482; 219/385, 391, 219/400

See application file for complete search history.

(56) References Cited

U.S. PATENT DOCUMENTS

| | | | |
|---|---|---|---|
| 3,358,122 | A | 12/1967 | Torrey |
| 4,865,010 | A | 9/1989 | Kett |
| 5,695,668 | A | 12/1997 | Boddy |
| 6,758,206 | B1 | 7/2004 | Barnes |
| 6,987,252 | B2 | 1/2006 | Goodrich |
| 7,378,617 | B1 | 5/2008 | Brockman |
| 8,049,142 | B2 | 11/2011 | Blackson |
| 10,012,392 | B2 | 7/2018 | Adelmann |
| 10,082,297 | B2 | 9/2018 | Kim |

(Continued)

FOREIGN PATENT DOCUMENTS

| | | |
|---|---|---|
| CN | 204795645 U | 11/2015 |
| EP | 2251609 B1 | 8/2017 |

(Continued)

*Primary Examiner* — Phuong T Nguyen
(74) *Attorney, Agent, or Firm* — Dority & Manning, P.A.

(57) ABSTRACT

An oven appliance may include a cabinet, a plurality of chamber walls, a cooking surface, a top heating element, a temperature sensor, and a controller. The cooking surface may be defined in a cooking chamber. The top heating element may be mounted above the cooking surface to heat the cooking chamber. The temperature sensor may be disposed within the cabinet. The controller may be configured to initiate a cooking operation that includes initiating preheat activation of the top heating element, receiving temperature signals from the temperature sensor during the preheat activation, determining a preheat threshold is met based on the received temperature signals, and initiating cooking activation of the top heating element based on a cooking cycle having a predetermined time interval subsequent to determining the preheat threshold is met. Initiating cooking activation may include directing the top heating element based on the cooking cycle for the predetermined time interval.

20 Claims, 6 Drawing Sheets

(56) References Cited

U.S. PATENT DOCUMENTS

| | | | |
|---|---|---|---|
| 10,448,457 | B2 | 10/2019 | Armstrong |
| 10,520,199 | B2 | 12/2019 | Polster |
| 2004/0149722 | A1 | 8/2004 | Dengler |
| 2017/0089590 | A1 | 3/2017 | Bruin-Slot |
| 2017/0130968 | A1 | 5/2017 | Nagraj |
| 2018/0003390 | A1 | 1/2018 | Vern |

FOREIGN PATENT DOCUMENTS

| | | | |
|---|---|---|---|
| JP | H07280281 | A | 10/1995 |
| JP | 2010112664 | A | 5/2010 |

OVEN APPLIANCE AND METHOD FOR PREHEATING HIGH-HEAT COOKING SURFACE

FIELD OF THE INVENTION

The present subject matter relates generally to oven appliances, and more particularly, to methods of operating an oven appliance for preheating a high-heat cooking surface.

BACKGROUND OF THE INVENTION

Conventional residential and commercial oven appliances generally include a cabinet that includes a cooking chamber for receipt of food items for cooking. Multiple gas or electric heating elements are positioned within the cabinet for heating the cooking chamber to cook food items located therein. The heating elements can include, for example, a bake heating assembly positioned at a bottom of the cooking chamber and a separate broiler heating assembly positioned at a top of the cooking chamber.

Typically, food or utensils for cooking are placed on wire racks within the cooking chamber and above the bake heating assembly. When the bake heating assembly is activated, heat from the bake heating assembly is thus forced to rise through an air gap, and any other intermediate elements, between the bake heating assembly and the wire rack before the utensil on the wire rack can be heated. Heat within the cooking chamber is relatively diffuse, and the temperature is generally consistent about the item or items on the rack.

Although these conventional configurations are useful for many types of foods, there are certain disadvantages. For instance, certain food items, such as pizzas or breads, may benefit from very high, localized (i.e., non-diffuse) heat for a relatively short amount of time. Some such cooking operations are commonly referred to as short-cycle cooking operations. Oftentimes, stone or specialized high-heat cooking surfaces are used for trapping heat against the bottom of flat-breads or pizza. Such cooking surfaces may be difficult to preheat or maintain at a specific temperature desired by the user. Traditional oven preheat methods alternate bottom and top heat in order to evenly heat the oven. This method would require a long period of time to bring a high-intensity oven's cooking surface to a "ready-to-cook" temperature. Alternatively, preheating a cooking surface with bottom heat only can result in uneven temperatures on the cooking surface, with areas near the bottom heater being hotter than those further away. This method also does not preheat the oven chamber, which can reduce cooking performance Accordingly, it would be advantageous to provide an oven appliance or methods for preheating a cooking surface and oven chamber and maintaining those temperatures throughout a cooking cycle.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a plurality of chamber walls, a cooking surface, a top heating element, an oven temperature sensor, a bottom heating element, a cooking surface temperature sensor, and a controller. The plurality of chamber walls may be mounted within the cabinet, the plurality of chamber walls defining a cooking chamber. The plurality of chamber walls may include a back wall, a top wall, a first side wall, a second side wall, and a bottom wall. The cooking surface may be defined in the cooking chamber between the bottom wall and the top wall of the plurality of chamber walls. The top heating element may be mounted above the cooking surface to heat the cooking chamber. The oven temperature sensor may be disposed within the cabinet. The bottom heating element may be mounted below the cooking surface to heat the cooking surface. The cooking surface temperature sensor may be disposed in proximity to the cooking surface. The controller may be in operative communication with the top heating element, the bottom heating element, the oven temperature sensor, and the cooking surface temperature sensor. The controller may be configured to initiate a cooking operation. The cooking operation may include initiating preheat activation of the bottom heating element, receiving one or more cooking surface temperature signals from the cooking surface temperature sensor, such receiving occurring during the preheat activation of the bottom heating element, determining a cooking surface preheat threshold is met, deactivating the bottom heating element based on the determination that the cooking surface preheat threshold is met, receiving one or more oven temperature signals from the oven temperature sensor, determining an oven preheat threshold is met, and maintaining an oven temperature and a cooking surface temperature by periodically activating one or more of the top heating element and the bottom heating element.

In another exemplary aspect of the present disclosure, a method of operating an oven appliance is provided. The method may include initiating preheat activation of the bottom heating element, receiving one or more cooking surface temperature signals from a cooking surface temperature sensor, receiving occurring during the preheat activation of the bottom heating element, determining a cooking surface preheat threshold is met based on the received one or more cooking surface temperature signals, deactivating the bottom heating element based on the determination that the cooking surface preheat threshold is met, receiving one or more oven temperature signals from the oven temperature sensor, determining an oven preheat threshold is met based on the received one or more oven temperature signals, and maintaining an oven temperature and a cooking surface temperature by periodically activating one or more of the top heating element and the bottom heating element.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
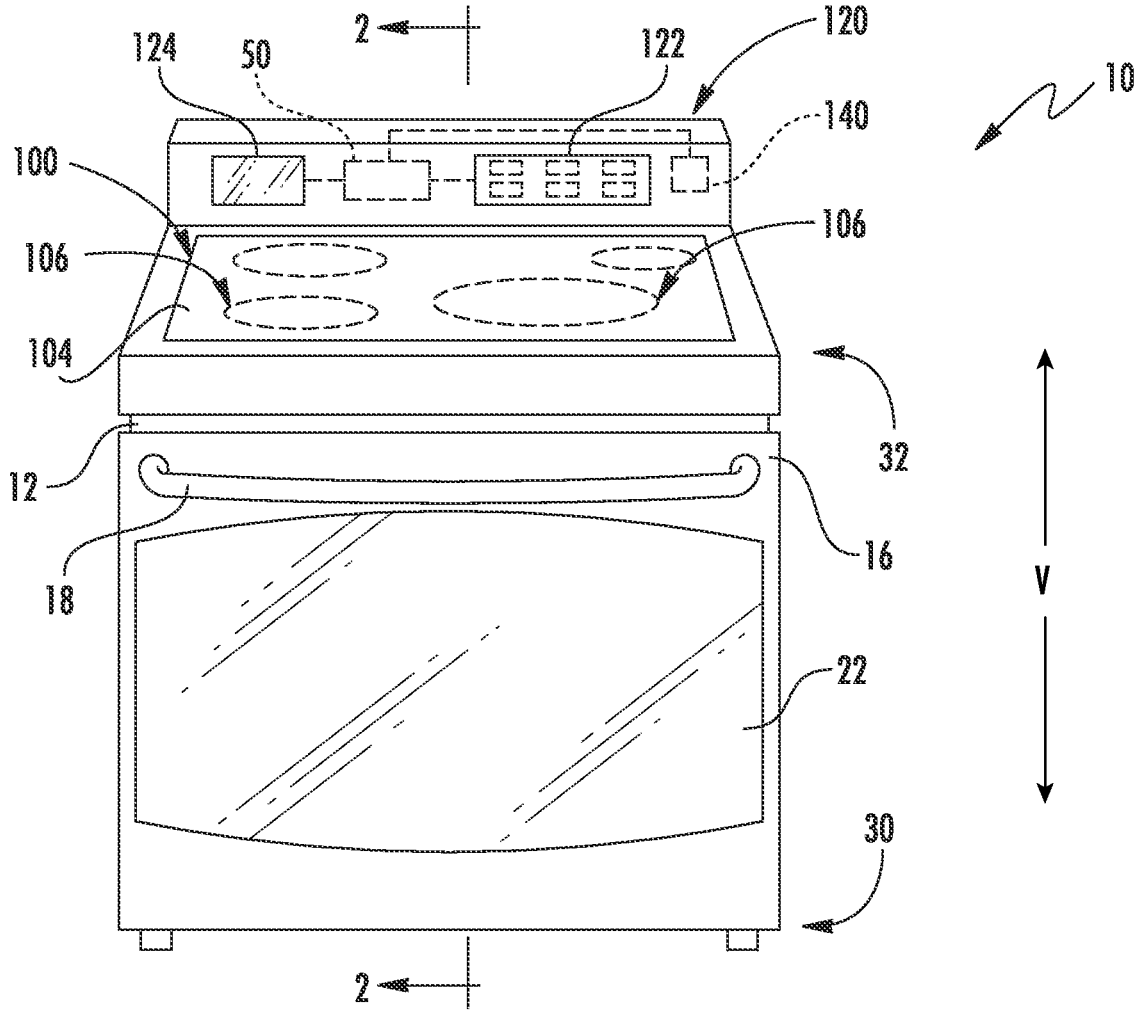
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
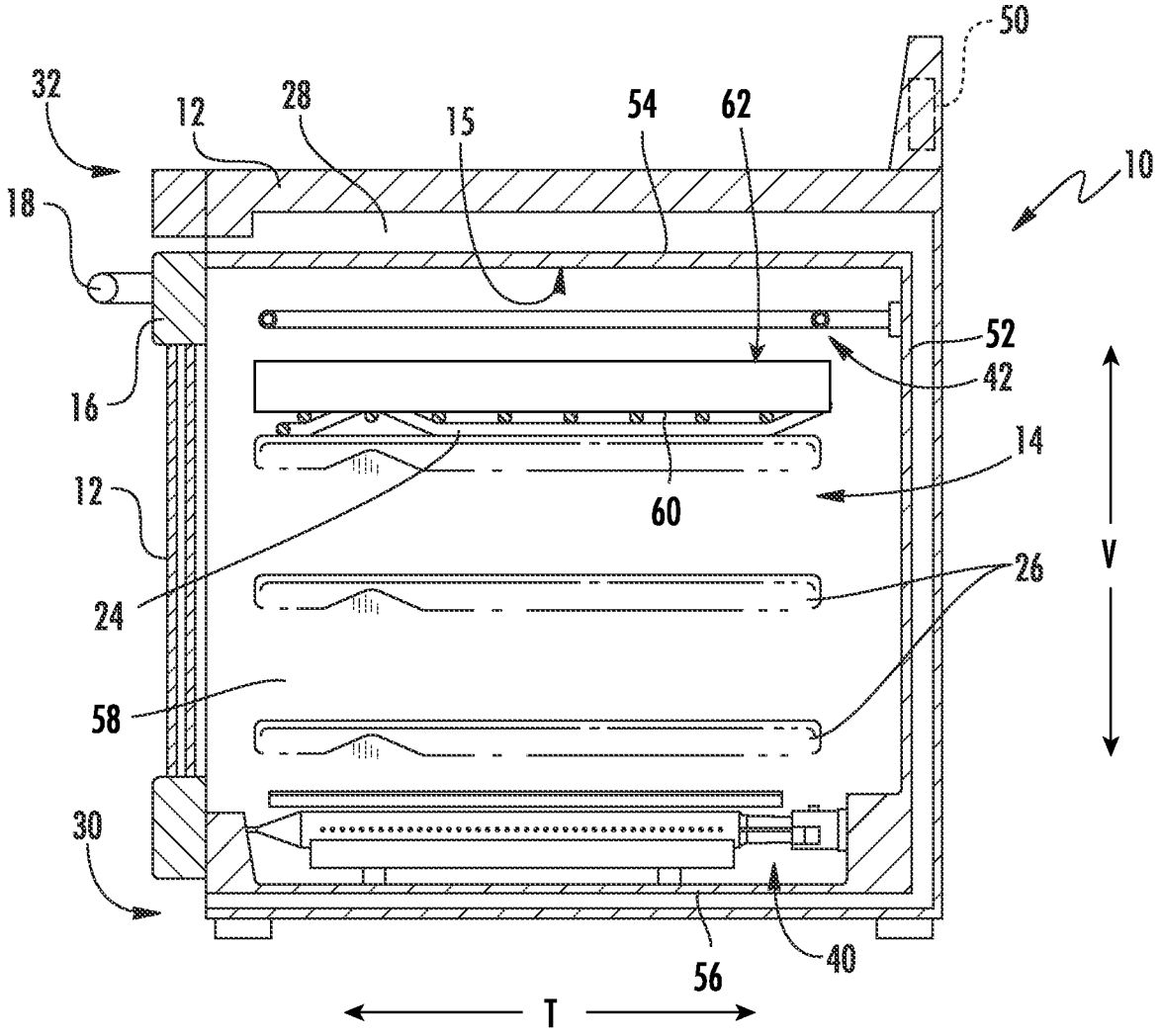
FIG. 2 provides a section view of the exemplary oven appliance of FIG. 1, taken along the line 2-2.

FIG. 1 provides a perspective view of an oven appliance 10 according to an exemplary embodiment of the present disclosure. FIG. 2 provides a section view of oven appliance 10 taken along the 2-2 line of FIG. 1. As may be seen, oven appliance 10 defines a vertical direction V, a lateral direction L and a transverse direction T. The vertical direction V, the lateral direction L and the transverse direction T are mutually perpendicular and form an orthogonal direction system.

Oven appliance 10 is provided by way of example only and is not intended to limit the present subject matter in any aspect. Other oven or range appliances having different configurations, different appearances, or different features may also be utilized with the present subject matter as well (e.g., double ovens, electric cooktop ovens, induction cooktop ovens, etc.).

Thus, the present subject matter may be used with other oven appliance configurations (e.g., that define one or more interior cavities for the receipt of food or having different cooking surface arrangements than what is shown in FIG. 2). Further, the present subject matter may be used in a standalone cooktop, range appliance, or any other suitable appliance.

Oven appliance 10 generally includes a cooking assembly. In particular, the cooking assembly may include one or more heating elements. For example, in some embodiments, the cooking assembly, and thus the oven appliance 10 includes an insulated cabinet 12 with an interior cooking chamber 14 defined by an interior surface 15 of cabinet 12. Cooking chamber 14 is configured for the receipt of one or more food items to be cooked. As shown, chamber 14 is generally defined by a back wall 52, a top wall 54, and a bottom wall 56 spaced from top wall 54 along the vertical direction V by opposing side walls 58 (e.g., a first wall and a second wall).

Oven appliance 10 includes a door 16 rotatably mounted to cabinet 12 (e.g., with a hinge—not shown). A handle 18 may be mounted to door 16 and assists a user with opening and closing door 16 in order to access cooking chamber 14. For example, a user can pull on handle 18 to open or close door 16 and access cooking chamber 14.

In some embodiments, oven appliance 10 includes a seal (not shown) between door 16 and cabinet 12 that assists with maintaining heat and cooking fumes within cooking chamber 14 when door 16 is closed as shown in FIG. 2. Multiple parallel glass panes 22 may provide for viewing the contents of cooking chamber 14 when door 16 is closed and assist with insulating cooking chamber 14. A baking rack 24 is positioned in cooking chamber 14 for the receipt of food items or utensils (e.g., cooking plate 60) that may contain or support food items. Baking rack 24 may be slidably received onto embossed ribs or sliding rails 26 such that rack 24 may be conveniently moved into and out of cooking chamber 14 when door 16 is open.

In some embodiments, baking rack 24 defines a receiving zone on or within which a cooking plate 60 is disposed (e.g., removably mounted or, alternatively, fixedly mounted). Generally, cooking plate 60 may provide a cooking surface 62 on which a food item (e.g., bread or pizza) may be received. Cooking plate 60 may be provided as a solid-nonpermeable member or, alternatively, define one or more apertures through which air may pass. In some embodiments, cooking plate 60 includes or is formed from a heat-retaining material, such as clay, stone (e.g., cordierite), ceramic, cast iron, aluminum alloy, or ceramic-coated carbon steel. It is understood that cooking plate 60 may be formed as any suitable shape (e.g., circular or rectangular) on which food items may be supported.

As shown, oven appliance 10 includes one or more heating elements 40, 42 to heat chamber 14 (e.g., as directed by a controller 50 as part of a cooking operation). In certain embodiments, a gas fueled or electric bottom heating element 40 (e.g., a gas burner, microwave heating element, a resistive heating element, resistance wire elements, radiant heating element, electric tubular heater or CALROD®, halogen heating element, etc.) is positioned in cabinet 12, for example, at a bottom portion 30 of cabinet 12. Bottom heating element 40 is used to heat cooking plate 60 and cooking surface 62, as well as cooking chamber 14. The size and heat output of bottom heating element 40 can be configured based on, for example, the size and composition of cooking plate 60 and the size of oven appliance 10.

In additional or alternative embodiments, a top heating element 42 (e.g., a gas burner, microwave heating element, a resistive heating element, resistance wire elements, radiant heating element, electric tubular heater or CALROD®, halogen heating element, etc.) is positioned in cooking chamber 14 of cabinet 12, for example, at a top portion 32 of cabinet 12. Top heating element 42 is used to heat cooking chamber 14 for both cooking/broiling and cleaning of oven appliance 10. Like bottom heating element 40, the size and heat output of top heating element 42 can be configured based on for example, the size of oven appliance 10.

Generally, oven appliance 10 may include a controller 50 in operative communication (e.g., operably coupled via a wired or wireless channel) with one or more other portions of oven appliance 10 (e.g., heating elements 40, 42) via, for example, one or more signal lines or shared communication busses, and signals generated in controller 50 operate oven appliance 10 in response to user input via user inputs 122 or input from sensors within oven appliance 10. Input/Output ("I/O") signals may be routed between controller 50 and various operational components of oven appliance 10 such that operation of oven appliance 10 can be regulated by controller 50. In addition, controller 50 may also be in operative communication (e.g., wired or, alternatively, wireless communication) with one or more sensors, such as a cooking surface temperature sensor ($TS_{CS}$) 64 or an oven temperature sensor ($TS_{Oven}$) 66. Generally, either or both $TS_{CS}$ 64 and $TS_{Oven}$ 66 may include or be provided as a thermistor, thermocouple, or resistance temperature detector ("RTD") which may be used to measure temperature at a location within or proximate to cooking surface 62 or chamber 14 and provide such measurements to the controller 50. Although $TS_{CS}$ 64 is illustrated as being mounted on cooking plate 60 and $TS_{Oven}$ 66 is illustrated on a back wall 52 between top heating element 42 and bottom heating element 40, it should be appreciated that other sensor types, positions, and configurations may be used according to alternative embodiments.

Controller 50 is a "processing device" or "controller 50" and may be embodied as described herein. Controller 50 may include a memory and one or more microprocessors, microcontrollers, application-specific integrated circuits (ASICS), CPUs or the like, such as general or special purpose microprocessors operable to execute programming instructions or micro-control code associated with operation of oven appliance 10, and controller 50 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 50 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

As shown in FIG. 2, in certain embodiments, a cooling air flow passageway 28 can be provided within cabinet 12 between cooking chamber 14 and cooktop 100. For example, a portion of passageway 28 may be between cooking chamber 14 and cooktop 100 along a vertical direction V. Passageway 28 is shown schematically in the figures. As will be understood by one of skill in the art using the teachings disclosed herein, cooling air flow passageway 28 may have a variety of configurations other than as shown. Air flowing through passageway 28 can provide convective cooling.

In optional embodiments, the oven appliance 10 additionally includes a cooktop 100. Cooktop 100 may be disposed on the cabinet 12 such that the total volume of cabinet 12 is generally divided between the cooking chamber 14 and cooktop 100. As shown, cooktop 100 may include a top panel 104. By way of example, top panel 104 may be constructed of glass, ceramics, enameled steel, and combinations thereof. Heating assemblies 106 (e.g., induction heating elements, resistive heating elements, radiant heating elements, microwave, or gas burners) may be mounted, for example, on or below the top panel 104. While shown with four heating assemblies 106 in the exemplary embodiment of FIG. 1, cooktop appliance 10 may include any number of heating assemblies 106 in alternative exemplary embodiments. Heating assemblies 106 can also have various diameters. For example, each heating assembly of heating assemblies 106 can have a different diameter, the same diameter, or any suitable combination thereof.

As shown, oven appliance 10 includes a user interface panel 120, which may be located as shown, within convenient reach of a user of the oven appliance 10. User interface panel 120 is generally a component that allows a user to interact with the oven appliance 10 to, for example, turn various heating elements (such as heating elements 40, 42) on and off, adjust the temperature of the heating elements, set built-in timers, etc. Although user interface panel 120 is shown mounted to a backsplash fixed to cabinet 12, alternative embodiments may provide user interface panel 120 at another suitable location (e.g., on a front portion of cabinet 12 above door 16).

In some embodiments, a user interface panel 120 may include one or more user-interface inputs 122 and a graphical display 124, which may be separate from or integrated with the user-interface inputs 122. The user-interface element 122 may include analog control elements (e.g., knobs, dials, or buttons) or digital control elements, such as a touchscreen comprising a plurality of elements thereon. Various commands for a user to select through the engagement with the user-interface inputs 122 may be displayed (e.g., by touchscreen at the inputs 122 or by the graphical display 124), and detection of the user selecting a specific command may be determined by the controller 50, which is in communication with the user-interface inputs 122, based on electrical signals therefrom. Additionally or alternatively, graphical display 124 may generally deliver certain information to the user, which may be based on user selections and interaction with the inputs 122, such as whether a one or more heating elements 40, 42 within cooking chamber 14 are activated or the temperature at which cooking chamber 14 is set. In certain embodiments, a discrete bake input is included with the inputs 122. User engagement of the bake input may activate the oven appliance 10 or initiate heating within cooking chamber 14 (e.g., such that cooking chamber 14 is directed to a default temperature setting).

Figure 3:
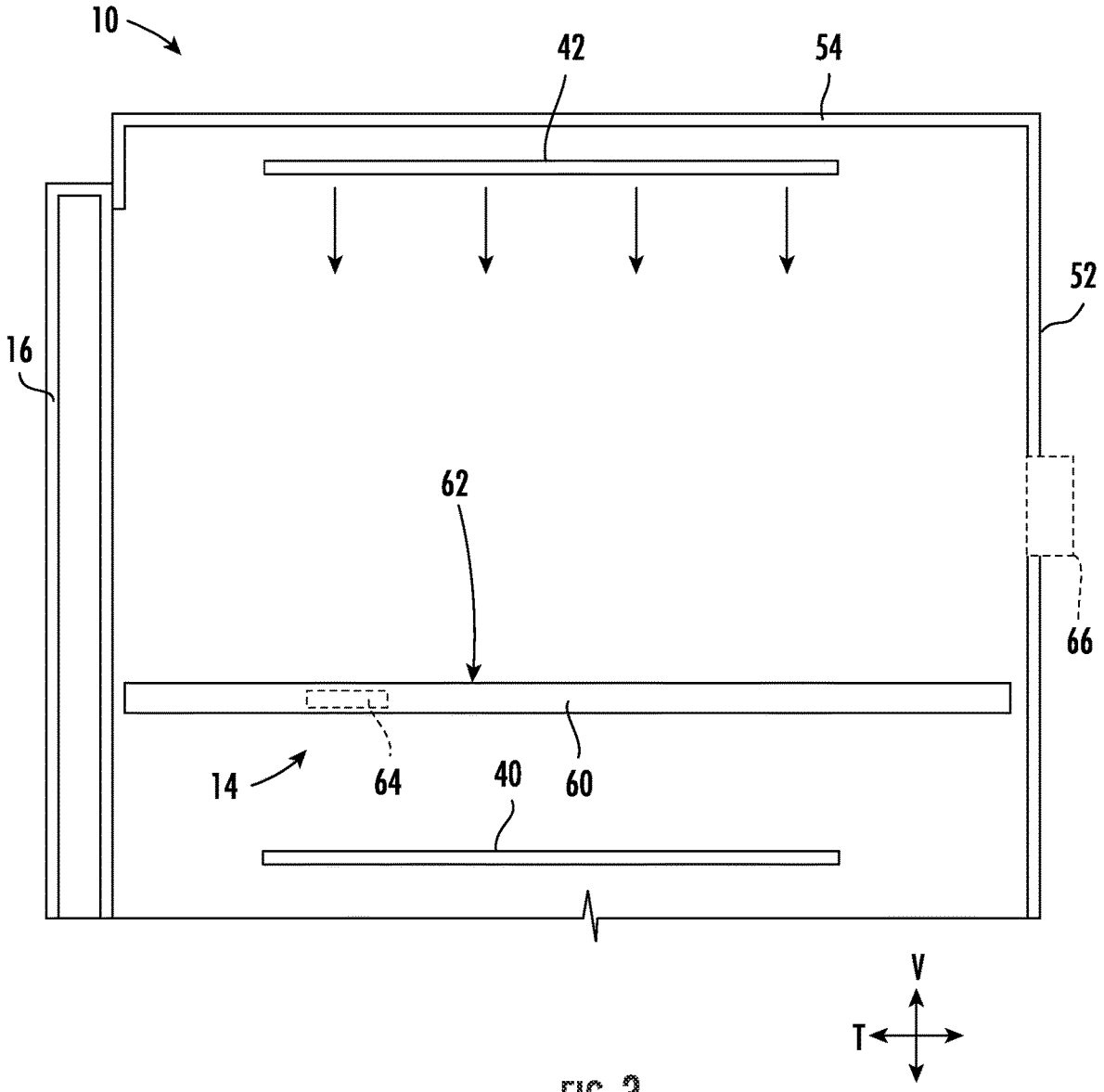
FIG. 3 provides a schematic section view of a portion of the exemplary oven appliance of FIG. 1.

Turning now to FIG. 3, a schematic section view of the upper end of oven 10, illustrating heat generated at top heating element 42 to cooking plate 60. As shown, one or more temperature sensors (e.g., $TS_{CS}$ 64) may be mounted to cooking plate 60, for instance, to detect the temperature within cooking plate 60 or at cooking surface 62. As an example, $TS_{CS}$ 64 may be disposed on a bottom surface of cooking plate 60 (e.g., via a mechanical fastener, clip, or hook). As an additional or alternative example, $TS_{CS}$ 64 may be held within a recess in cooking plate 60. As an additional or alternative example, $TS_{CS}$ 64 may be embedded within cooking plate 60.

Additionally or alternatively, one or more temperature sensors (e.g., $TS_{Oven}$ 66) may be disposed within the cabinet 12 proximate to or within chamber 14, for instance, to detect the (e.g., general or diffuse) temperature of chamber 14 below top heating element 42. Optionally, $TS_{Oven}$ 66 may be mounted between the top heating element 42 and the bottom heating element 40. In some embodiments, $TS_{Oven}$ 66 is mounted to a chamber wall. Specifically, $TS_{Oven}$ 66 may be laterally positioned between the side walls 58 or vertically positioned between the top wall 54 and bottom wall 56. As an example, $TS_{Oven}$ 66 may be disposed on back wall 52 (e.g., via a mechanical fastener, clip, or hook). As an additional or alternative example, $TS_{Oven}$ 66 may be held within a recess in back wall 52. As an additional or alternative example, $TS_{Oven}$ 66 may be embedded within back wall 52.

When assembled, the temperature sensor(s) $TS_{CS}$ 64, $TS_{Oven}$ 66 may be operably coupled to controller 50. Moreover, the controller 50 may be configured to control top heating element 42 or bottom heating element 40 based on the temperature detected at the temperature sensor(s) $TS_{CS}$, $TS_{Oven}$, (e.g., as part of a cooking operation, such as a short-cycle cooking operation). In some embodiments, a cooking operation initiated by the controller 50 may thus include detecting one or more temperatures of $TS_{CS}$ 64 and $TS_{Oven}$ 66, and directing heat output from (e.g., a heat setting of) top heating element 42 or bottom heating element 40 based on the detected temperature.

Figure 4:
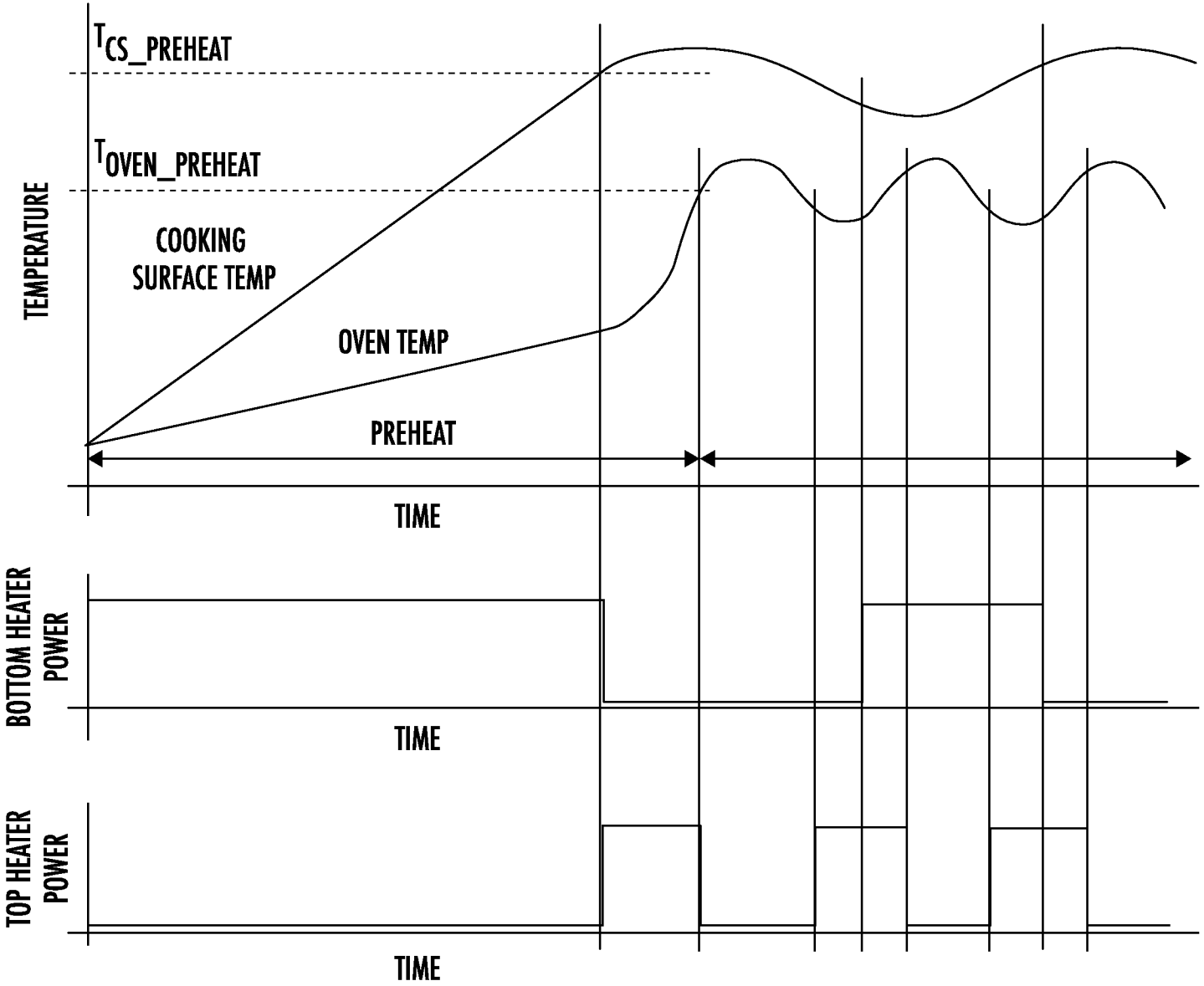
FIG. 4 is a graph view illustrating temperature over time for a cooking surface temperature sensor mounted on a cooking plate and for an oven temperature sensor mounted in the cabinet within an oven appliance during a high-heat cooking operation according to exemplary embodiments of the present disclosure.

As an example, and turning briefly to FIG. 4, a graph is provided to illustrate a short-cycle preheat and temperature maintenance cooking operation directed by controller 50 (FIG. 1) in operative communication with heating elements 40, 42, $TS_{CS}$ 64, and $TS_{Oven}$. In particular, the upper portion of FIG. 4 provides a graph of temperature line $T_{CS_PREHEAT}$ detected by $TS_{CS}$ 64. It further provides a graph of temperature line $T_{Oven_PREHEAT}$ detected by $TS_{Oven}$ 66. The lower portion of FIG. 4 provides a graph of output line P for power output as a percentage of maximum output (e.g., as dictated by a duty cycle or TRIAC) at bottom heating element 40 and top heating element 42. As shown, the cooking operation may include a preheat cycle in which bottom heating element 40 is activated and top heating element 42 is off or at low power. Alternative, in other embodiments, bottom heating element 40 and top heating element 42 may operate independently and optionally both heating elements may operate simultaneously during portions of the preheat cycle.

The preheat cycle may be initiated, for instance, in response to an input signal received from user interface panel 120 (e.g., based on a user selection for the short-cycle cooking operation). Generally, during the preheat cycle, temperature (e.g., as measured along $T_{CS_PREHEAT}$) increases at the cooking surface 62 until a cooking surface preheat threshold is met based on the temperature signals from the cooking surface temperature sensor $TS_{CS}$ 64. For instance, the preheat cycle may continue until a cooking surface preheat threshold is met or exceeded (e.g., at $T_{CS_PREHEAT}$). In alternative embodiments, the cooking surface preheat threshold may be the expiration of a fixed dwell time. Still other embodiments may employ the Proportional-Integral-Derivative (PID) method, controlling the output of the bottom heating element 40 and/or the top heating element 42 based on how far the cooking surface and oven temperatures, respectively, are from a predetermined set point. Some embodiments may involve utilization of bottom heating element 40 and top heating element 42 by powering them on and off, as shown in FIG. 4. In other embodiments, power delivered to bottom heating element 40 and top heating element 42 may fluctuate between 0-100% using TRIAC control method.

Once the cooking surface preheat threshold is met, the bottom heating element 40 is deactivated and the preheat cycle is completed. Advantageously, the cooking plate 60 or surface 62 within the chamber 14 may be brought to a relatively high temperature without reaching excessive or undesirable temperatures within the rest of chamber 14. Additionally, or in the alternative, once the cooking surface preheat threshold is met, bottom heating element 40 is deactivated and top heating element 42 is activated. Heating of the cooking chamber 14 continues until controller 50 determines that a threshold oven temperature is met (i.e., $TS_{Oven}$ 66 reaches a threshold oven temperature, $T_{Oven_PREHEAT}$). Upon reaching this threshold oven temperature, top heating element 42 is deactivated and the preheat cycle ends. One of ordinary skill in the art will recognize that alternative embodiments in accordance with this invention may be employed. For example, bottom heating element 40 and top heating element 42 may operate simultaneous and independently based on the respective cooking surface and oven temperatures. Alternatively, in certain embodiment, only one of bottom heating element 40 and top heating element 42 may be used during the preheat cycle to control both the cooking surface and oven temperatures.

Following the preheat cycle (e.g., immediately thereafter), a maintenance cycle may be initiated in which bottom heating element 40 and/or top heating element 42 are directed to maintain the cooking surface temperature and oven temperatures, for example within a range of temperatures. In one embodiment, the maintenance cycle is characterized by operation of both the bottom heating element 40 and top heating element 42. Operation of bottom heating element 40 and top heating element 42 may occur sequentially or simultaneously.

In the embodiment of FIG. 4, the maintenance cycle begins with bottom heating element 40 and top heating element 42 deactivated. The cooking surface and oven temperatures are monitored based on the outputs of $TS_{CS}$ 64 and $TS_{Oven}$ 66, respectively. Once the cooking surface temperature drops below a lower cooking surface temperature threshold, bottom heating element 40 is activated. Similarly, once the oven temperature drops below a lower oven temperature threshold, top heating element 42 is activated.

In the embodiment of FIG. 4, the maintenance cycle continues, with respect to oven temperature, by periodically reading the oven temperature using $TS_{Oven}$ 66. When the upper oven temperature threshold is met, top heating element 42 is deactivated. Top heating element 42 remains deactivated until a lower oven temperature threshold is met, as determined based on the output of $TS_{Oven}$ 66. The upper oven temperature threshold and the lower oven temperature threshold are generally temperatures respectively above and below $T_{Oven_PREHEAT}$ by several degrees (e.g., five degrees Fahrenheit above and below the desired oven temperature). This process may be repeated until the cooking cycle is complete. In this way, the temperature within the oven chamber is maintained with a narrow temperature range. In alternative embodiments, it may be desirable to overshoot the upper oven temperature threshold when transitioning between the preheat and maintenance cycle in view of the practical reality that the oven door is likely to be opened during this period of time, resulting in significant heat loss within chamber 14. In this embodiment, the preheat cycle involves keeping top heating element 42 activated beyond the threshold oven temperature until the oven temperature $T_{Oven_PREHEAT}$ reaches a temperature high enough to account for the anticipated heat loss from opening of the oven door (e.g., 20 degrees Fahrenheit above the upper oven temperature threshold). Similarly, in other embodiments, it may be desirable to undershoot the lower oven temperature threshold when transitioning between the preheat and maintenance cycle. For example, even after bottom heating element 40 is deactivated, heat continues to soak through cooking surface 62 from its bottom surface to its top surface, increasing top surface temperature and contributing to increased temperature within chamber 14. In this embodiment, the preheat cycle involves deactivating top heating element 42 before it reaches the lower oven temperature threshold (e.g., 20 degrees Fahrenheit below the lower oven temperature threshold) in anticipation of this added source of heat.

As further shown in the embodiment of FIG. 4, the bottom heating element 40 may operate independently to maintain the temperature of cooking surface 62, as measured by $TS_{CS}$ 64. In this embodiment, the maintenance cycle begins with bottom heating element 40 deactivated. When the temperature of the cooking surface drops below a lower cooking surface temperature threshold, bottom heating element 42 is activated. Bottom heating element 40 remains activated until the temperature of cooking surface 62 rises above an upper cooking surface temperature threshold, at which time bottom heating element 40 is deactivated. The lower cooking surface temperature threshold and the upper cooking surface temperature threshold are generally temperatures respectively below and above $T_{CS_PREHEAT}$ by several degrees (e.g., five degrees Fahrenheit above and below the desired cooking surface temperature). This process may be repeated until the cooking cycle is complete. In this way, the temperature of the cooking surface is maintained within a narrow range. In alternative embodiments, it may be desirable to overshoot the upper cooking surface temperature threshold when transitioning between the preheat and maintenance cycle in view of the practical reality that the oven door is likely to be opened during this period of time, resulting in significant heat from cooking surface 62. In this embodiment, the preheat cycle involves keeping bottom heating element 40 activated beyond the threshold cooking surface temperature until the cooking surface temperature $T_{CS}$ reaches a temperature high enough to account for the anticipated heat loss from opening of the oven door (e.g., 20 degrees Fahrenheit above the upper cooking surface temperature threshold). Similarly, in other embodiments, it may be desirable to undershoot the lower cooking surface temperature threshold when transitioning between the preheat and maintenance cycle. For example, even after bottom heating element 40 is deactivated, heat continues to soak through cooking surface 62 from its bottom surface to its top surface, increasing top surface temperature. In this embodiment, the preheat cycle involves deactivating bottom heating element 40 before it reaches the lower cooking surface temperature threshold (e.g., 20 degrees Fahrenheit below the lower cooking surface temperature threshold) in anticipation of this added source of heat.

As in the preheat cycle, embodiments of the invention may involve operation of bottom heating element 40 and top heating element 42 simultaneously or sequentially. Control of bottom heating element 40 and top heating element 42 may be executed using temperature thresholds, as described with respect to the embodiment of FIG. 4, or may use a PID technique to maintain the oven and cooking surface temperatures. Further, whereas the embodiment of FIG. 4 shows utilization of bottom heating element 40 and top heating element 42 in an on/off configuration, they may be controlled by a TRIAC, enabling finer control by controlling the output power of bottom heating element 40 and top heating element 42 between 0-100%. Using this technique, therefore, embodiments of the invention merely lower the power delivered to bottom heating element 40 and/or top heating element 42 when the temperatures of cooking surface 62 or oven chamber 14 exceed a threshold and raise the power to bottom heating element 40 and top heating element 42 when temperatures of cooking surface 62 or oven chamber 14 drop below a threshold. In yet another alternative embodiment, TRIAC control may be employed to control the power output to bottom heating element 40 and top heating element 42 use a PID loop.

Figure 5:
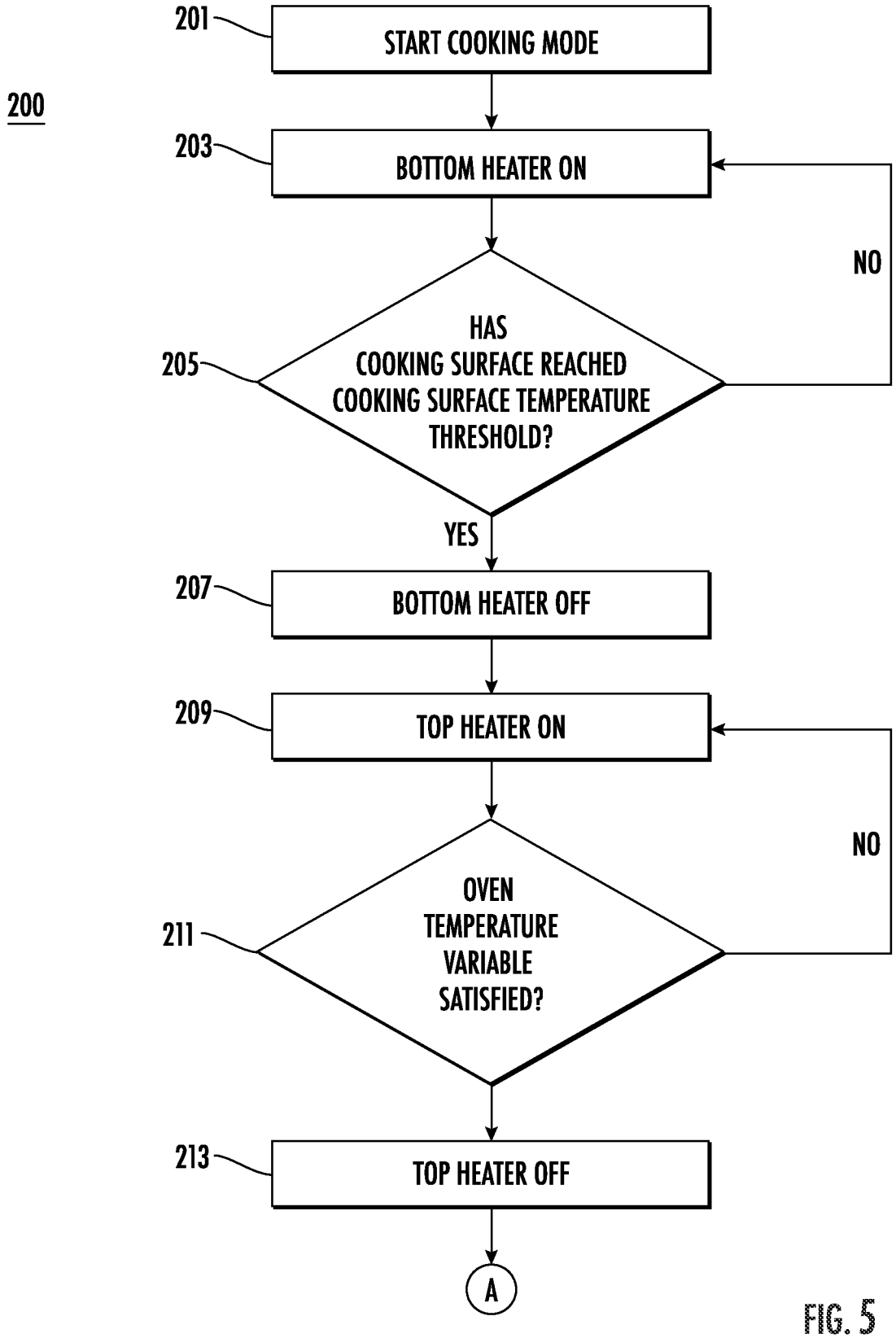
FIG. 5 is a flow chart illustrating a method of operating an oven appliance during a preheat cycle according to exemplary embodiments of the present disclosure.
Figure 6:
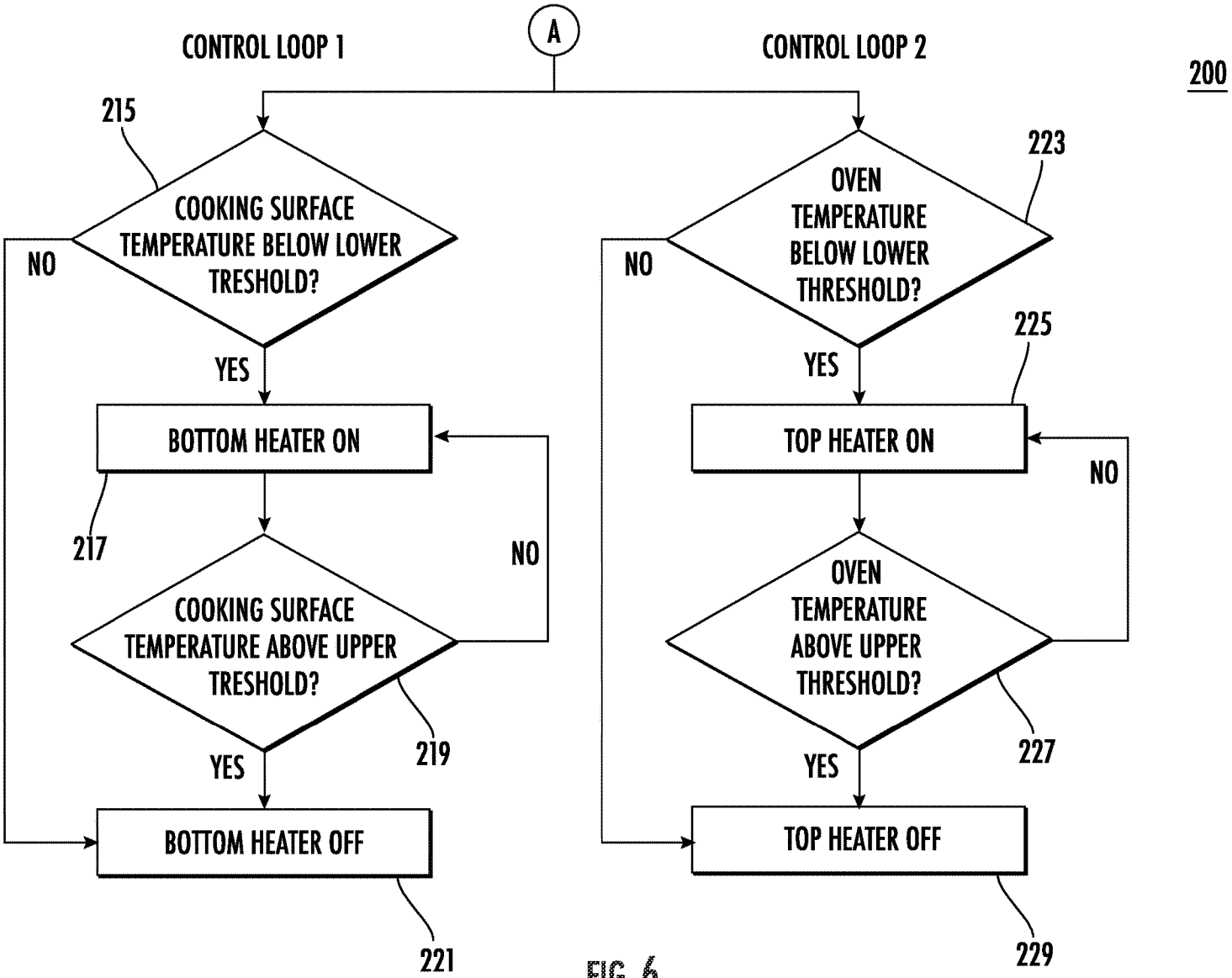
FIG. 6 is a flow chart illustrating a method of operating an oven appliance during a maintenance cycle accordingly to exemplary embodiments of the present disclosure.

Referring now to FIGS. 5 and 6, the present disclosure may further be directed to methods (e.g., method 200) of operating an oven appliance, such as appliance 10. In exemplary embodiments, the controller 50 may be operable to perform various steps of a method in accordance with the present disclosure.

The methods (e.g., 200) may occur as, or as part of, a preheating and maintenance cooking operation of oven appliance 10. In particular, the methods (e.g., 200) disclosed herein may advantageously facilitate a cooking plate or surface within a cooking chamber to be brought to a relatively high temperature without reaching excessive or undesirable temperatures within the rest of the cooking chamber. Additionally or alternatively, the methods (e.g., 200) may advantageously permit multiple cooking cycles to be performed in relatively quick succession (e.g., without requiring deactivation of all heating elements or significant cooling of the cooking chamber).

It is noted that the order of steps within method 200 are for illustrative purposes. Except as otherwise indicated, one or more steps in the below method 200 may be changed, rearranged, performed in a different order, or otherwise modified without deviating from the scope of the present disclosure.

Turning now to FIG. 5, at 201, the method 200 includes starting a cooking mode, which initiates a preheat cycle to raise the temperature of a cooking surface and oven chamber. Generally, the initiation of the cooking mode may indicate that a short-cycle or localized, high-heat cooking operation is planned (e.g., by a user). For instance, the short-cycle preheat signal may correspond to a user input (e.g., at the user interface panel). Thus, user engagement of a short-cycle button or input at the user interface panel may transmit the short-cycle preheat signal to the controller.

At 203, the method 200 includes initiating preheat activation of a bottom heating element. Specifically, preheat activation of the bottom heating element may be initiated as part of a preheat cycle of the oven appliance. In some embodiments, 203 includes turning on or otherwise increasing power or fuel to the bottom heating element (e.g., from 0%). For instance, the bottom heating element may be activated according to a predetermined preheat power or heat output setting (e.g., as a percentage of maximum output as dictated by a duty cycle or TRIAC), such a first heat output setting.

In certain embodiments, the predetermined preheat power output of the bottom heating element is a relatively high output setting (e.g., greater than 50%). Optionally, the predetermined first heat output setting of the bottom heating element may be greater than 75%. Additionally or alternatively, the predetermined first heat output setting of the bottom heating element may be between 80% and 100%. For instance, the first heat output setting may be 100% (i.e., the maximum permitted output setting).

Generally, once activated, the bottom heating element may be maintained in an active state in which power or fuel is directed to the bottom heating element to generate heat for the duration of the preheat cycle (or for a portion of the preheat cycle in embodiments where the top heating element is used to preheat the cooking chamber independently). For instance, the power or heat output of the bottom heating element may be maintained above 0% (e.g., at a directed duty cycle or constant output). Optionally, the power or heat output of the bottom heating element may be maintained at the first heat output setting.

At 205, the method 200 includes receiving one or more cooking surface temperature signals from a cooking surface temperature sensor during the preheat activation of the bottom heating element and determining whether a cooking surface preheat threshold is met based on the received one or more cooking surface temperature signals. When the temperature signals from the cooking surface temperature sensor are below the cooking surface preheat threshold, the bottom heating elements continues to be activated and step 203 is repeated. Alternatively or additionally, in embodiments involving variable control of the bottom heating element, the power or fuel for the bottom heating element may be adjusted based on the difference between the current temperature signals from the cooking surface temperature sensor and the cooking surface preheat threshold.

When it is determined that the temperature signals from the cooking surface temperature sensor meet or exceed the cooking surface preheat threshold, the bottom heating element is deactivated at 207. For instance, the power or heat output of the bottom heating element may be maintained at 0%. In some embodiments, 205 continues throughout the cooking cycle, merely reducing the power or fuel to bottom heating element, rather than deactivating it entirely, as described above.

At 209, the method 200 includes activating the top heating element based on the determination that the cooking surface preheat threshold is met. For instance, temperature signals may be received by the controller at a predetermined rate or at regular intervals to determine the temperature of the cooking surface. The temperature signals of 205 may be received during the preheat cycle. In certain embodiments, 209 occurs during preheat cycle. In alternative embodiments, activation of the top heating element may occur prior to the determination that the cooking surface preheat threshold is met, thus resulting in the bottom heating element and top heating element operating simultaneously. In the alternative, or in addition, the top heating element may operate with variable power or fuel input during the preheat cycle.

At 211, the method 200 includes receiving one or more oven temperature signals from the oven temperature sensor and an oven preheat threshold is met based on the received one or more oven temperature signals. When the temperature signals from the oven temperature sensor are below the cooking surface preheat threshold, the to heating elements continues to be activated and step 209 is repeated. When the temperature signals from the oven temperature sensor are above oven preheat threshold, method 200 proceeds to 213 and the top heating element is deactivated. Alternatively or additionally, in embodiments involving variable control of the top heating element, the power or fuel for the top heating element may be adjusted based on the difference between the current temperature signals from the cooking surface temperature sensor and the cooking surface preheat threshold.

In some embodiments, as described above, determining whether an oven preheat threshold is met may be determined based on the of signals received from the oven temperature sensor. For example, the oven preheat threshold may be a predetermined oven preheat temperature maximum set by the user or otherwise within a range of the target temperature (e.g., within 5° F.) that represents the upper desired temperature of the oven chamber. Thus, when the oven chamber temperature reaches the predetermined oven preheat temperature maximum, the top heating element is deactivated or powered down. In alternative embodiments, the oven preheat threshold may be a change in temperature over time, as measured by the oven temperature sensor. For example, the controller may store the temperature of the oven chamber at the time that the top heating element is activated. A predetermined temperature rise (e.g., 400° F.) may serve as the oven preheat threshold such that as controller receives measurements from repeated readings of the oven temperature sensor, it calculates the difference between the current oven chamber temperature and the original oven chamber temperature previously stored. When the difference between the two reaches the predetermined temperature rise, the top heating element is deactivated or otherwise powered down.

The oven preheat threshold is not necessarily based on the output of the oven temperature sensor. For example, in some embodiments, the oven preheat threshold may be based on elapsed time. That is, the controller measures the time elapsed between activation of the top heating element and the present time. When the elapsed time reaches a predetermined threshold (e.g., 10 minutes), then the top heating element may be deactivated or otherwise powered down. One of ordinary skill in the art will recognized that a variety of other variables could be used to satisfy the oven preheat threshold as well. In particular, other embodiments may employ any combination of oven preheat thresholds, requiring that two or more conditions are met (e.g., temperature exceeds a maximum threshold and elapsed time exceeds a preheat threshold) prior to deactivating or otherwise powering down the top heating element.

Upon deactivating or powering down of the top heating element at 213, method 200 enters into a maintenance cycle in which the cooking surface temperature and oven chamber temperature are regulated to maintain their respective temperatures within an acceptable range by periodically activating one or more of the top heating element and the bottom heating element. As shown in FIG. 6, method 200 maintains the cooking surface temperature and the oven chamber temperature using two separate control loops. In control loop 1 at 215, method 200 determines whether the cooking surface temperature is below a lower temperature threshold based on the output of the cooking surface temperature sensor. The lower temperature threshold of the cooking surface represents the predetermined lower bound of an acceptable temperature range at which the cooking surface is to be maintained (e.g. 5° F. below the target temperature). If the cooking surface temperature is below the lower temperature threshold, the bottom heating element is activated or otherwise receives an increase in power at step 217. If the cooking surface temperature is above the lower temperature threshold, the bottom heating remains off or at low power at step 221. In that case, control loop 1 is repeated until the end of the cooking cycle.

In the case that the bottom heating element is activated at step 217, method 200 determines whether the cooking surface temperature is above a cooking surface upper temperature threshold at step 219. The upper temperature threshold of the cooking surface represents the predetermined upper bound of an acceptable temperature range at which the cooking surface is to be maintained (e.g. 5° F. above the target temperature). If the cooking surface temperature is above the upper temperature threshold, the bottom heating element is deactivated or otherwise receives a decrease in power at step 221, and control loop 1 is repeated until the cooking cycle is complete. If it is determined at step 219 that the cooking surface temperature is below the upper temperature threshold, the bottom heating elements remains activated and control loop 1 continues at 217.

Upon deactivating or powering down of the top heating element at 213, method 200 also maintains the oven chamber temperature in parallel to its maintenance of the cooking surface temperature using control loop 2, as shown in FIG. 6. In control loop 2 at 2232, method 200 determines whether the oven temperature is below a lower temperature threshold based on the output of the oven temperature sensor. The lower temperature threshold of the oven represents the predetermined lower bound of an acceptable temperature range at which the oven chamber is to be maintained (e.g. 5° F. below the target temperature). If the oven temperature is below the lower temperature threshold, the top heating element is activated or otherwise receives an increase in power at step 225. If the oven temperature is above the lower temperature threshold, the top heating remains off or at low power at step 229. In that case, control loop 2 is repeated until the end of the cooking cycle.

In the case that the top heating element is activated at step 225, method 200 determines whether the cooking surface temperature is above the oven upper temperature threshold at step 227. The upper temperature threshold of the oven represents the predetermined upper bound of an acceptable temperature range at which the oven chamber is to be maintained (e.g. 5° F. above the target temperature). If the oven temperature is above the upper temperature threshold, the top heating element is deactivated or otherwise receives a decrease in power at step 229, and control loop 2 is repeated until the cooking cycle is complete. If it is determined at step 227 that the oven temperature is below the upper temperature threshold, the top heating elements remains activated and control loop 2 continues at 225.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet;

a plurality of chamber walls mounted within the cabinet, the plurality of chamber walls defining a cooking chamber, the plurality of chamber walls comprising a back wall, a top wall, a first side wall, a second side wall, and a bottom wall;

a cooking surface defined in the cooking chamber between the bottom wall and the top wall of the plurality of chamber walls;

a top heating element mounted above the cooking surface to heat the cooking chamber;

an oven temperature sensor disposed within the cabinet;

a bottom heating element mounted below the cooking surface to heat the cooking surface;

a cooking surface temperature sensor disposed in proximity to the cooking surface; and a controller in operative communication with the top heating element, the oven temperature sensor, the bottom heating element, and the cooking surface temperature sensor, the controller being configured to initiate a cooking operation comprising initiating preheat activation of the bottom heating element;

receiving one or more cooking surface temperature signals from the cooking surface temperature sensor, receiving occurring during the preheat activation of the bottom heating element;

determining a cooking surface preheat threshold is met;

deactivating the bottom heating element based on the determination that the cooking surface preheat threshold is met;

receiving one or more oven temperature signals from the oven temperature sensor;

determining an oven preheat threshold is met; and maintaining an oven temperature and a cooking surface temperature by periodically activating one or more of the top heating element and the bottom heating element.

2. The oven appliance of claim 1, wherein initiating the cooking operation further includes activating the top heating element based on the determination that the cooking surface preheat threshold is met.

3. The oven appliance of claim 1, wherein the cooking surface preheat threshold is met when the output temperature of the cooking surface temperature sensor exceeds a predetermined maximum cooking surface temperature.

4. The oven appliance of claim 1, wherein the oven preheat threshold is met when the output of the oven temperature sensor exceeds a predetermined maximum oven temperature.

5. The oven appliance of claim 1, wherein the oven preheat threshold is met when the rise in the output temperature of oven temperature sensor exceeds a predetermined amount.

6. The oven appliance of claim 1, wherein the oven preheat threshold is met when the amount of time since initiating preheat activation of the bottom heating element exceeds a predetermined amount.

7. The oven appliance of claim 1, wherein the oven preheat threshold is met when the amount of time since initiating preheat activation of the top heating element exceeds a predetermined amount.

8. The oven appliance of claim 1, wherein maintaining an oven temperature and a cooking surface temperature further includes activating only the bottom heating element.

9. The oven appliance of claim 1, wherein maintaining an oven temperature and a cooking surface temperature further includes activating both the top heating element and the bottom heating element simultaneously.

10. The oven appliance of claim 1, wherein maintaining an oven temperature and a cooking surface temperature further includes activating both the top heating element and the bottom heating element sequentially.

11. A method of operating an oven appliance comprising a plurality of chamber walls mounted within a cabinet and defining a cooking chamber, a cooking surface defined in the cooking chamber between a bottom wall and a top wall of the plurality of chamber walls, a top heating element mounted above the cooking surface to heat the cooking chamber, and a bottom heating element mounted below the cooking surface to heat the cooking surface, the method comprising:

initiating preheat activation of the bottom heating element;

receiving one or more cooking surface temperature signals from a cooking surface temperature sensor, receiving occurring during the preheat activation of the bottom heating element;

determining a cooking surface preheat threshold is met based on the received one or more cooking surface temperature signals;

deactivating the bottom heating element based on the determination that the cooking surface preheat threshold is met;

receiving one or more oven temperature signals from the oven temperature sensor;

determining an oven preheat threshold is met based on the received one or more oven temperature signals; and maintaining an oven temperature and a cooking surface temperature by periodically activating one or more of the top heating element and the bottom heating element.

12. The method of claim 11, further including the step of activating the top heating element based on the determination that the cooking surface preheat threshold is met.

13. The method of claim 11, wherein the cooking surface preheat threshold is met when the output temperature of the cooking surface temperature sensor exceeds a predetermined maximum cooking surface temperature.

14. The method of claim 11, wherein the oven preheat threshold is met when the output of the oven temperature sensor exceeds a predetermined maximum oven temperature.

15. The method of claim 11, wherein the oven preheat threshold is met when the rise in the output temperature of oven temperature sensor exceeds a predetermined amount.

16. The method of claim 11, wherein the oven preheat threshold is met when the amount of time since initiating preheat activation of the bottom heating element exceeds a predetermined amount.

17. The method of claim 11, wherein the oven preheat threshold is met when the amount of time since initiating preheat activation of the top heating element exceeds a predetermined amount.

18. The method of claim 11, wherein maintaining a cooking surface temperature further includes activating the bottom heating element when the output of the cooking surface temperature sensor is below a lower cooking surface temperature threshold; and deactivating the bottom heating element when the output of the cooking surface temperature sensor is above an upper cooking surface temperature threshold.

19. The method of claim 18, wherein maintaining an oven temperature further includes activating the top heating element when the output of the oven temperature sensor is below a lower oven temperature threshold; and deactivating the top heating element when the output of the oven temperature sensor is above an upper oven temperature threshold.

20. The method of claim 19, wherein maintaining an oven temperature and a cooking surface temperature further includes activating both the top heating element and the bottom heating element simultaneously.

* * * * *